US010153566B2

(12) United States Patent
Zhang et al.

(10) Patent No.: US 10,153,566 B2
(45) Date of Patent: Dec. 11, 2018

(54) ELECTRICAL CONNECTOR HAVING AN IMPROVED TERMINAL

(71) Applicant: FOXCONN INTERCONNECT TECHNOLOGY LIMITED, Grand Cayman (KY)

(72) Inventors: Jian-Li Zhang, HuaiAn (CN); Tao Yao, Huaian (CN); Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/614,638

(22) Filed: Jun. 6, 2017

(65) Prior Publication Data

US 2017/0352968 A1 Dec. 7, 2017

(30) Foreign Application Priority Data

Jun. 6, 2016 (CN) ..... 2016 1 0391477

(51) Int. Cl.
*H01R 12/55* (2011.01)
*H01R 24/30* (2011.01)
(Continued)

(52) U.S. Cl.
CPC ..... *H01R 12/55* (2013.01); *H01R 13/516* (2013.01); *H01R 13/648* (2013.01);
(Continued)

(58) Field of Classification Search
CPC ..... H01R 13/6594; H01R 13/6658; H01R 24/30; H01R 13/6467; H01R 12/55; H01R 13/516; H01R 13/648
See application file for complete search history.

(56) References Cited

U.S. PATENT DOCUMENTS 9,478,905 B2 10/2016 Golko et al.
9,577,373 B2 * 2/2017 Kato ..... H01R 13/6275
(Continued)

FOREIGN PATENT DOCUMENTS

| | | |
|---|---|---|
| CN | 204315752 | 5/2015 |
| CN | 105375143 | 3/2016 |
| TW | M518830 | 3/2016 |

*Primary Examiner* — Renee S Luebke
*Assistant Examiner* — Paul Baillargeon
(74) *Attorney, Agent, or Firm* — Wei Te Chung; Ming Chieh Chang

(57) ABSTRACT

An electrical connector includes: an insulative housing comprising a base portion and a tongue portion extending forwardly from the base portion; a number of upper and low terminals mounted in the insulative housing and exposed to an upper surface and a lower surface of the tongue portion, the upper terminals and the lower terminals being equal in number, both the upper terminals and the lower terminals comprising five intermediate terminals arranged centrally in succession and one grounding terminal spaced from the five intermediate terminals by two terminal positions, each of the five intermediate terminals having a reserved space for not arranging a terminal, the five intermediate terminals comprising an auxiliary terminal; and a shielding plate disposed between the upper terminals and the lower terminals.

18 Claims, 14 Drawing Sheets

(51) Int. Cl.

| | |
|---|---|
| ***H01R 13/6585*** | (2011.01) |
| ***H01R 13/516*** | (2006.01) |
| ***H01R 13/648*** | (2006.01) |
| ***H01R 13/6594*** | (2011.01) |
| ***H01R 13/66*** | (2006.01) |
| ***H01R 24/60*** | (2011.01) |

(52) U.S. Cl.
CPC ..... *H01R 13/6585* (2013.01); *H01R 13/6594* (2013.01); *H01R 13/6658* (2013.01); *H01R 24/30* (2013.01); *H01R 24/60* (2013.01)

(56) References Cited

U.S. PATENT DOCUMENTS

| | | | | |
|---|---|---|---|---|
| 9,601,883 | B1 * | 3/2017 | Chung | H01R 13/6461 |
| 9,647,369 | B2 * | 5/2017 | Tsai | H01R 4/02 |
| 9,735,522 | B2 * | 8/2017 | Chen | H01R 24/62 |
| 2015/0044886 | A1 | 2/2015 | Little et al. | |
| 2015/0171573 | A1 * | 6/2015 | Little | H01R 24/60 439/607.34 |
| 2016/0181733 | A1 * | 6/2016 | Duan | H01R 13/6594 439/607.05 |
| 2016/0372870 | A1 | 12/2016 | Guo | |
| 2017/0018883 | A1 | 1/2017 | Chen et al. | |
| 2017/0117673 | A1 | 4/2017 | Zhang | |
| 2017/0133797 | A1 | 5/2017 | Guo et al. | |

* cited by examiner

| A1 | A2 | A3 | A4 | A5 | A6 | A7 | A8 | A9 | A10 | A11 | A12 |
|---|---|---|---|---|---|---|---|---|---|---|---|
| | | | | CC1 | D+ | D− | SBU1 | Vbus | | | GND |
| GND | | | Vbus | SBU2 | D− | D+ | CC2 | | | | |
| B12 | B11 | B10 | B9 | B8 | B7 | B6 | B5 | B4 | B3 | B2 | B1 |

FIG. 14

ELECTRICAL CONNECTOR HAVING AN IMPROVED TERMINAL

BACKGROUND OF THE DISCLOSURE

1. Field of the Disclosure

The present disclosure relates to an electrical connector, and more particularly to an electrical connector adapted for normally and reversely mating.

2. Description of Related Arts

China Patent No. 204315752 discloses a reversible or dual orientation USB Type-C connector comprising two rows of contacts. Each row of contacts includes a detecting terminal located at the fifth position, a positive signal terminal located at the sixth position, a negative signal located at the seventh position, a power terminal located at the ninth position, and a grounding terminal located at the twelfth position. The electrical connector is not designed to deliver high current or auxiliary signal.

An improved electrical connector is desired.

SUMMARY OF THE DISCLOSURE

Accordingly, an object of the present disclosure is to provide an electrical connector adapted for normally and reversely mating.

To achieve the above object, an electrical connector comprises: an insulative housing comprising a base portion and a tongue portion extending forwardly from the base portion; a plurality of upper and low terminals mounted in the insulative housing and exposed to an upper surface and a lower surface of the tongue portion, the upper terminals and the lower terminals being equal in number, both the upper terminals and the lower terminals comprising five intermediate terminals arranged centrally in succession and one grounding terminal spaced from the five intermediate terminals by two terminal positions, each of the five intermediate terminals having a reserved space for not arranging a terminal, the five intermediate terminals comprising an auxiliary terminal; and a shielding plate disposed between the upper terminals and the lower terminals.

Other objects, advantages and novel features of the disclosure will become more apparent from the following detailed description when taken in conjunction with the accompanying drawings.

BRIEF DESCRIPTION OF THE DRAWINGS

FIG. 14 schematically shows a diagram of conductive terminals positions of the electrical connector.

DETAILED DESCRIPTION OF THE PREFERRED EMBODIMENT

Figure 1:
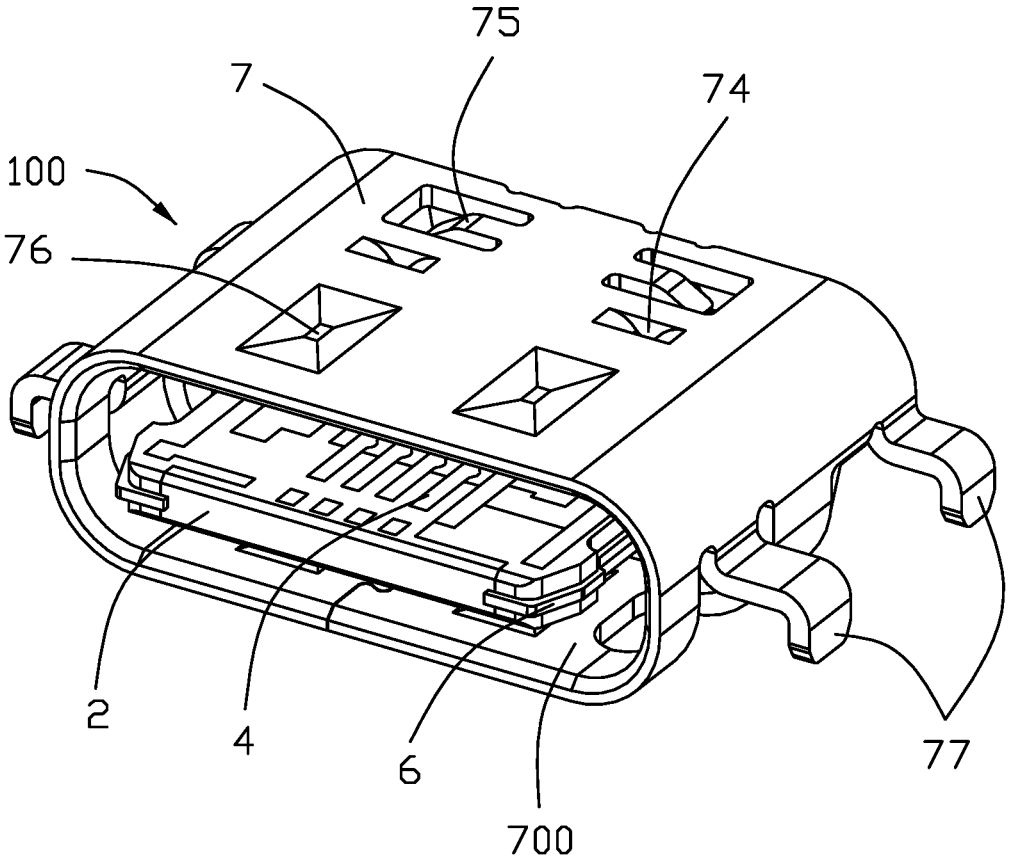
FIG. 1 is a perspective, assembled view of an electrical connector.
Figure 2:
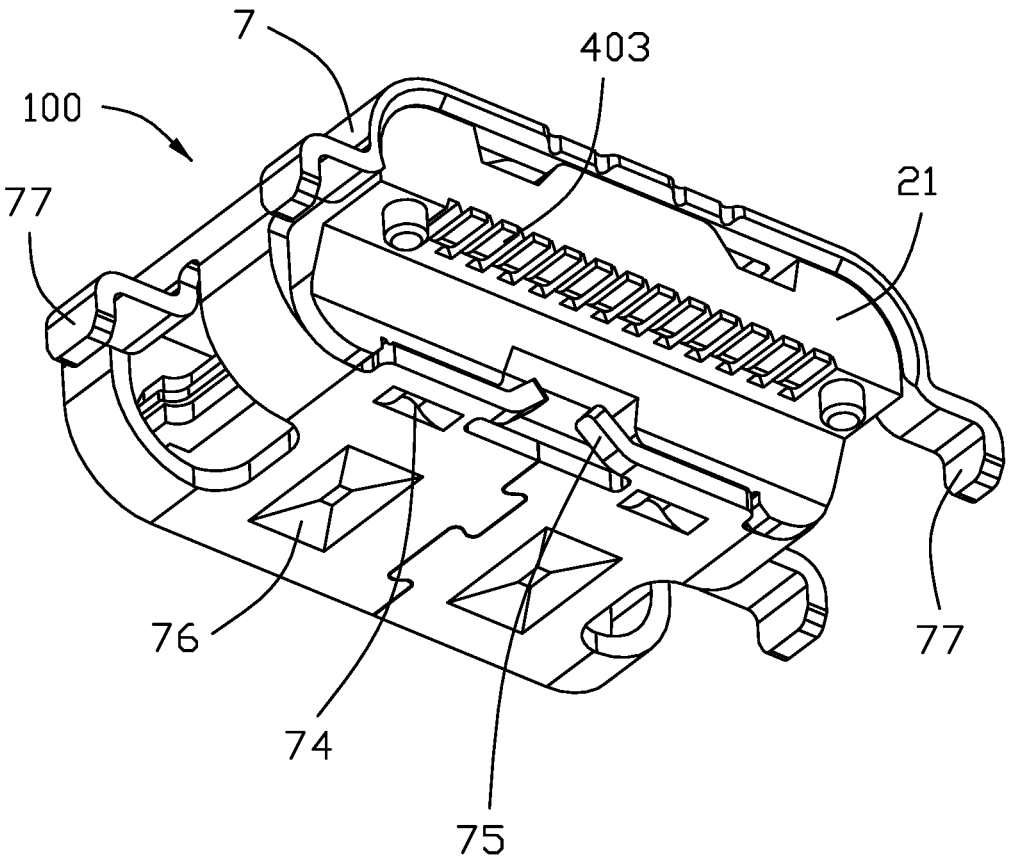
FIG. 2 is another perspective, assembled view of the electrical connector taken from FIG. 1.
Figure 3:
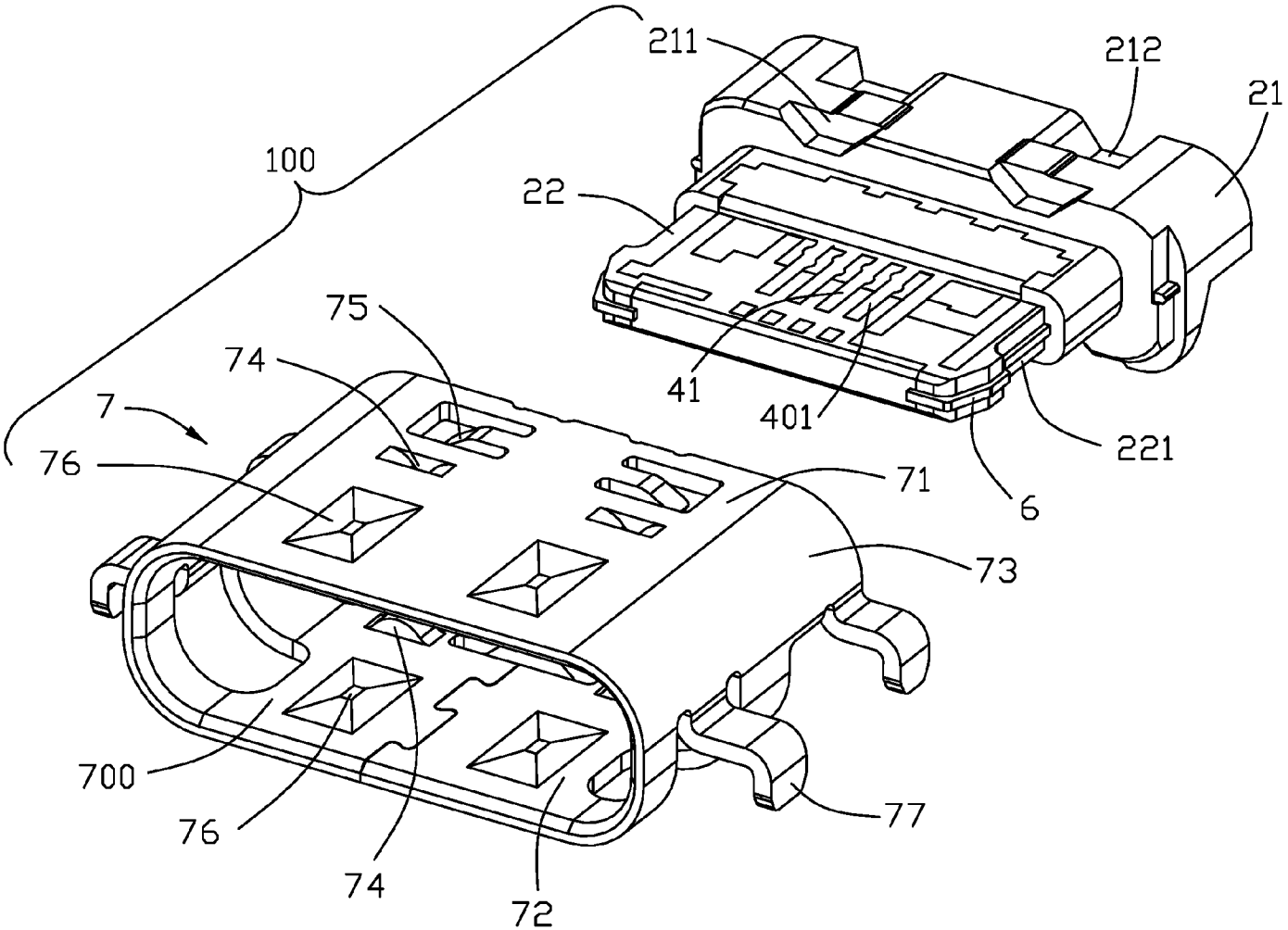
FIG. 3 is a partial exploded view of the electrical connector.
Figure 4:
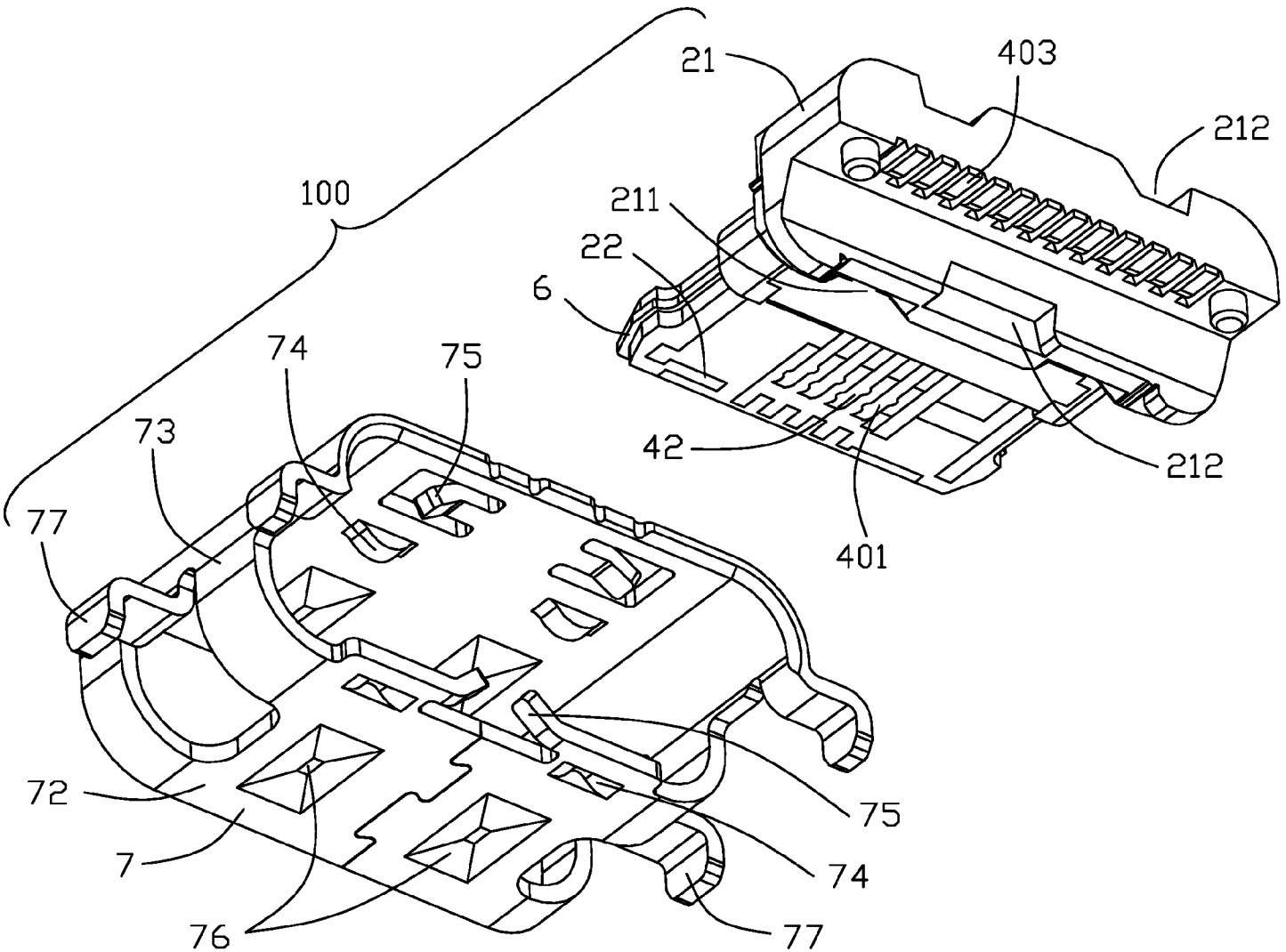
FIG. 4 is another partial exploded view of the electrical connector taken from FIG. 3.
Figure 5:
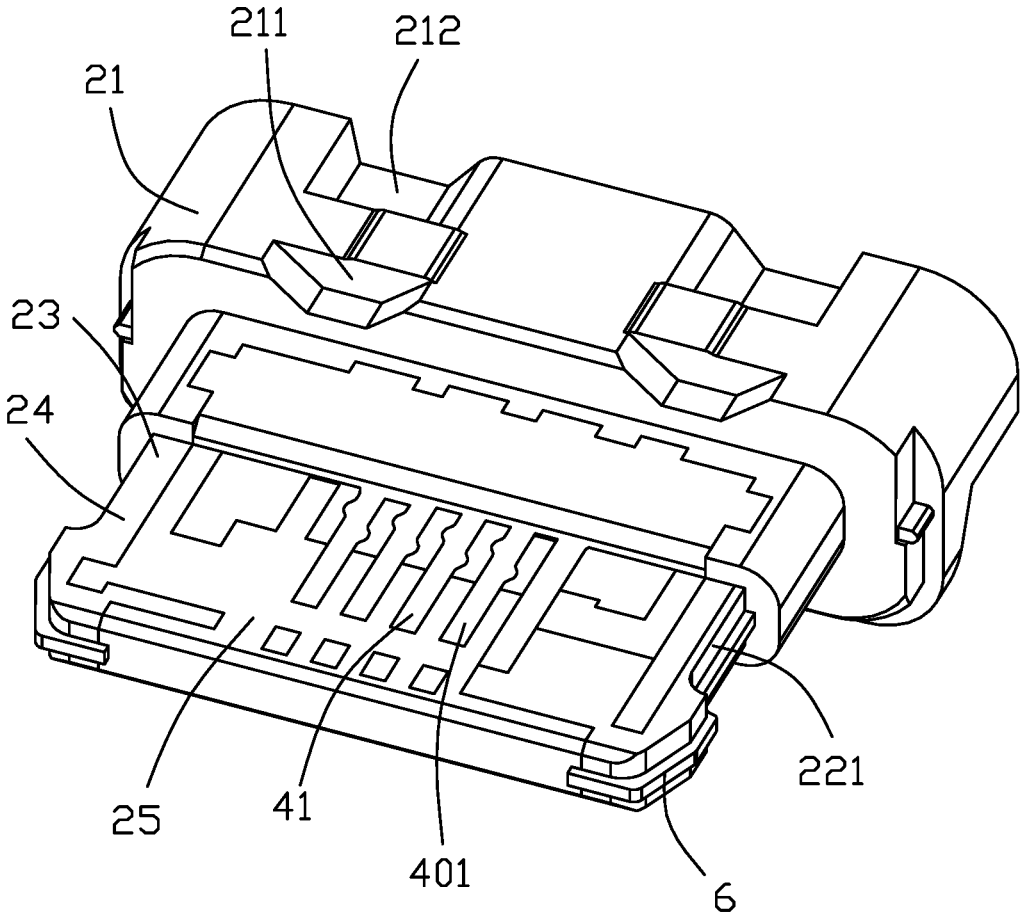
FIG. 5 is a perspective, assembled view of the electrical connector removing a shielding shell.
Figure 6:
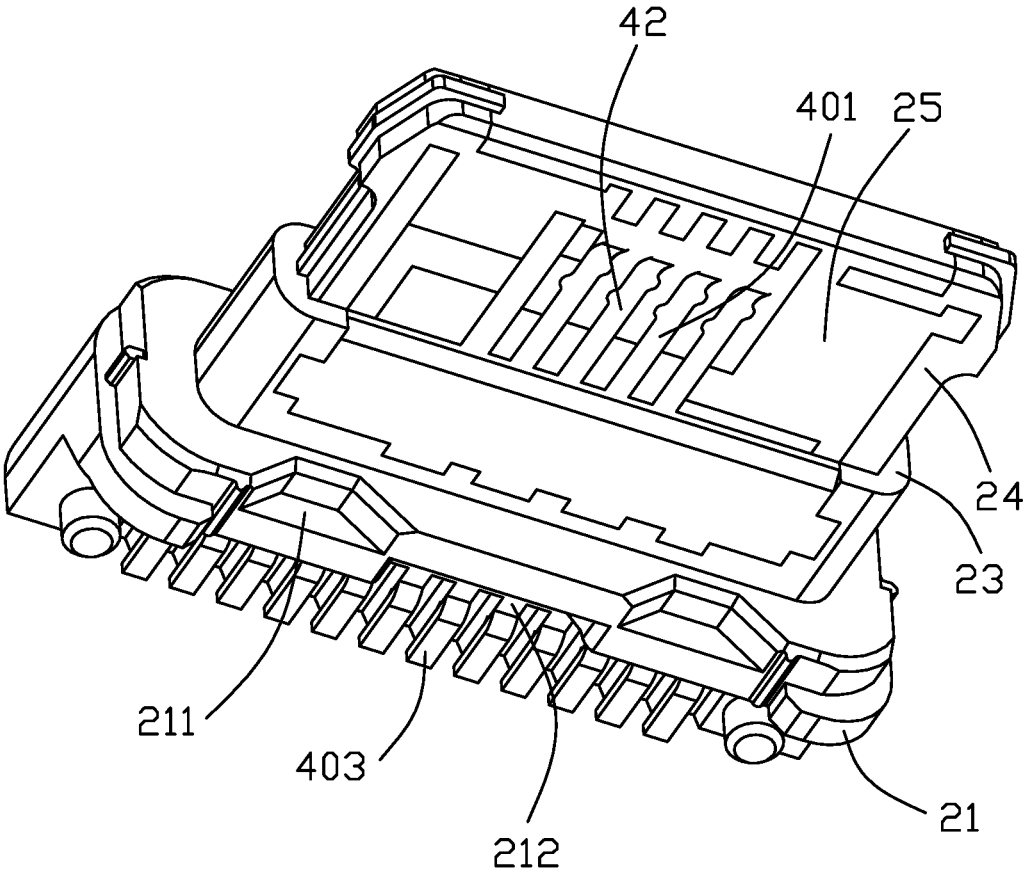
FIG. 6 is another perspective, assembled view of the electrical connector taken from FIG. 5.

Reference will now be made in detail to the embodiments of the present disclosure. The insertion direction is a front-to-rear direction.

Referring to FIGS. 1 to 13, an electrical connector 100 includes an insulative housing 2, a number of conductive terminals 4 arranged in two rows, a shielding plate 6, and a shielding shell 7 enclosing the insulative housing 2. The electrical connector 100 is of a sink-type that is suspended in a groove of a printed circuit board (not shown) in the electronic device (not shown).

Referring to FIGS. 1 to 13, the insulative housing 2 includes a base portion 21 and a tongue portion 22 extending forwardly from the base portion 21. The base portion 21 includes a number of front resisting grooves 211 surrounding a front end of the base portion and a number of rear resisting grooves 212 surrounding a rear end of the base portion. The insulative housing 2 further includes a pair of lateral slots 221 located at two lateral sides of the tongue portion for mating with a corresponded electrical connector. The tongue portion 22 defines an upper surface and a lower surface opposite to the upper surface. The tongue portion 22 includes a number of receiving grooves 241 respectively located at the upper surface and the lower surface. The insulative housing 2 includes a first insulator 23 and a second insulator 25. The first insulator 23 includes the base portion 21 and a first tongue portion 24 extending forwardly from the base portion 21. The first tongue portion 24 and the second insulator 25 form the tongue portion 22.

Referring to FIGS. 5 to 13, the conductive terminals 4 arranged in two rows include a number of upper terminals 41 and a number of lower terminals 42. Each conductive terminal 4 includes a front contacting portion 401 exposed to the upper surface or the lower surface of the tongue portion 22, a middle fixing portion 402 partially affixed to the tongue portion 22 and the base portion 21, and a rear soldering/tail portion 403 extending outwardly from the base portion 21.

Arrangement of the upper terminals 41 and the lower terminals 42 on the tongue portion 22 is generally symmetrical in the sense that orientation of the electrical connector can be flipped. As shown in FIG. 14, twelve terminal positions, A1 through A12 from left to right, are defined on the upper surface of the tongue portion 22 and twelve terminal positions, B1 through B12 from right to left, are defined on the lower surface of the tongue portion 22. The six upper terminals 41 occupy the positions A5, A6, A7, A8, A9, and A12 while the six lower terminals 42 occupy the positions B5, B6, B7, B8, B9, and B12. Each row of the conductive terminals 4 includes four first contacts 43 occupying the positions A5, A6, A7, A8, one power terminal occupying the position A9, and one grounding terminal occupying the position A12. The first contacts 43 are a detecting terminal occupying the position A5, a USB2.0 positive signal terminal occupying the position A6, a USB2.0 negative signal terminal occupying the position A7, and an auxiliary terminal occupying the position A8. The detecting terminal occupying the position A5, the USB2.0 positive signal terminal occupying the position A6, the USB2.0 negative signal terminal occupying the position A7, the auxiliary terminal occupying the position A8 and the power terminal occupying the position A9 are called intermediate terminals. There is a respective reserved space formed between every two adjacent terminals of the five intermediate terminals. The auxiliary terminal is disposed at eighth position A8 out of the twelve terminal positions on the tongue portion 22 and can be used for transmitting required signals as needed. There is no conductive terminal at the first through the fourth terminal positions, the tenth terminal position, and the eleventh terminal position in order to form a space. The space enlarges the distance between the conductive terminals 4, enabling the electrical connector 100 to conduct large current of about 3 A to 5 A. Each first contact 43 includes a front portion 431 and an ear 432 extending laterally from the contacting portion 401. The reserved space receives the ears 432 that is to be pressed by molds during manufacturing.

The upper terminals 41 and the lower terminals 42 are equal in number and each includes six conductive terminals 4. Each contacting portion 401 of the upper terminals 41 is positioned in reverse symmetry with respect to a respective one of the lower terminals 42. The auxiliary terminal could transmit auxiliary signal according to specialized demand increasing the diversity of the signal transmission.

Referring to FIGS. 5 to 13, the shielding plate 6 is planar and has a main portion 61. The shielding plate 6 further includes a left section 62, a right section 63 arranged in symmetry with the left section 62, and a connecting arm 64 connecting the left section 62 and the right section 63.

Referring to FIGS. 1 to 4, the shielding shell 7 includes a top wall 71, a bottom wall 72 opposite to the top wall, and a pair of lateral walls 73 connecting the top wall 71 and the bottom wall 72 for forming a mating room 700. The shielding shell 7 includes a number of front resisting portions 74 located at the top wall 71 and the bottom wall 72, a number of rear resisting portions 75 located at the top wall 71 and the bottom wall 72, a number of dimples or tubers 76 located at the top wall 71 and the bottom wall 72, and a number of fixing pins 77 located at the lateral walls 73. The front resisting portions 74 and the rear resisting portions 75 are bent and formed in the mating room 700 by shearing and forming operation. The tubers 76 protrude into the mating room 700 by stamping and forming operation. Corresponding shielding shell of a mating electrical connector contacts the tubers 76 for grounding. The fixing pins 77 are symmetrically disposed on both lateral walls 73 and are bent outwardly by shearing and forming operation.

Referring to FIGS. 1 to 14, the upper terminals 41, the lower terminals 42, the shielding plate 6 and the first insulator 23 are insert molded to be an integrated unit. Firstly, during insert molding, the upper terminals 41, the lower terminals 42, and the left section 62 and the right section 63 of the shielding plate 6 are resisted in the vertical direction by the mold. The first contacts 43 are resisted in the vertical direction by way of the ears 432. Secondly molten insulative material are insert molded with the upper terminals 41, the lower terminals 42, and the shielding plate 6. Eventually the mold is withdrawn and cutoff bridges of the conductive terminals 4 exposed to the receiving grooves 241 are severed.

The shielding plate is sandwiched between the upper terminals and the lower terminals. The contacting portion 401 of the upper terminals 41 are exposed to an upper surface of the first tongue portion 24. The contacting portion 401 of the lower terminals 42 are exposed to a lower surface of the first tongue portion 24. A number of front ends of the contacting portions 401 of the power terminals and the grounding terminals of the upper terminals 41 and the lower terminals 42 are embedded in a front end of the first tongue portion 24. The front portions 431 of the first contacts 43 of the upper terminals 41 and lower terminals 42 are embedded in the front end of the first tongue portion 24. The front portions 431 of the first contacts 43 of the lower terminal 42 are laterally offset with respect to the front portions 431 of the first contacts 43 of the upper terminal 41 for allowing the mold from resisting against and preventing the first contacts 43 of the two rows of conductive terminals 4 from connecting with each other. The soldering portions 403 of the upper terminals 41 and the lower terminals 42 are engaged in a row in a transverse direction.

The receiving grooves 241 are allocated among the first terminal position to forth terminal position, the tenth terminal position to the eleventh terminal position and between the first contacts 43. The lower surfaces of the power terminal and the grounding terminal of the upper terminals 41 are partially exposed to the receiving grooves 241. The upper surfaces of the power terminal and the grounding terminal of the lower terminal 42 are partially exposed to the receiving grooves 241. The ears 432 of the first contacts 43 of the upper terminals 41 and the lower terminals 42 are exposed to the receiving grooves 241. The left section 62 and the right section 63 of the shielding plate 6 are partially exposed to the receiving grooves 241. The ears 432 of the lower terminals 42, the connecting arm of the shielding plate 6, and the ears 432 of the upper terminals 41 are offset from each other in the front-to-rear direction.

The second insulator 25 is insert-molded with the integrated unit. The second insulator 25 fills in the receiving grooves 241 and encloses the front portions 431 of the first contacts 43. The two lateral sides of the main portion 61 extend outwardly from two sides of the tongue portion 22 for mating with the corresponded electrical connector.

The insulative housing 2 affixed with the conductive terminals 2 and the shielding plate 6 is assembled to the shielding shell 7 along a rear-to-front direction opposite to the front-to-rear direction. The front resisting portions 74 of the shielding shell 7 resist rearward against the front resisting grooves 211 while the rear resisting portions 75 of the shielding shell 7 resist forwardly against the rear resisting grooves 212 for fixing the insulative housing 2 in the front-to-rear direction and the rear-to-front direction. The fixing pins 77 are mounted to a printed circuit board (not shown) of an electrical device (not shown). The soldering portions 403 of the upper terminals 41 and the lower terminals 42 are soldered to the print circuit board.

In the embodiment, the shielding plate 6 is not connected with the shielding shell 7 rather they are connected with a mating electrical connector for grounding purpose. In other embodiments, the shielding plate 6 includes a pair of grounding pins (not shown) located at two sides of the main portion 61. The grounding pins extend outwardly from the base portion 21 to connect with an inner surface of the shielding shell 7 for grounding.

Figure 7:
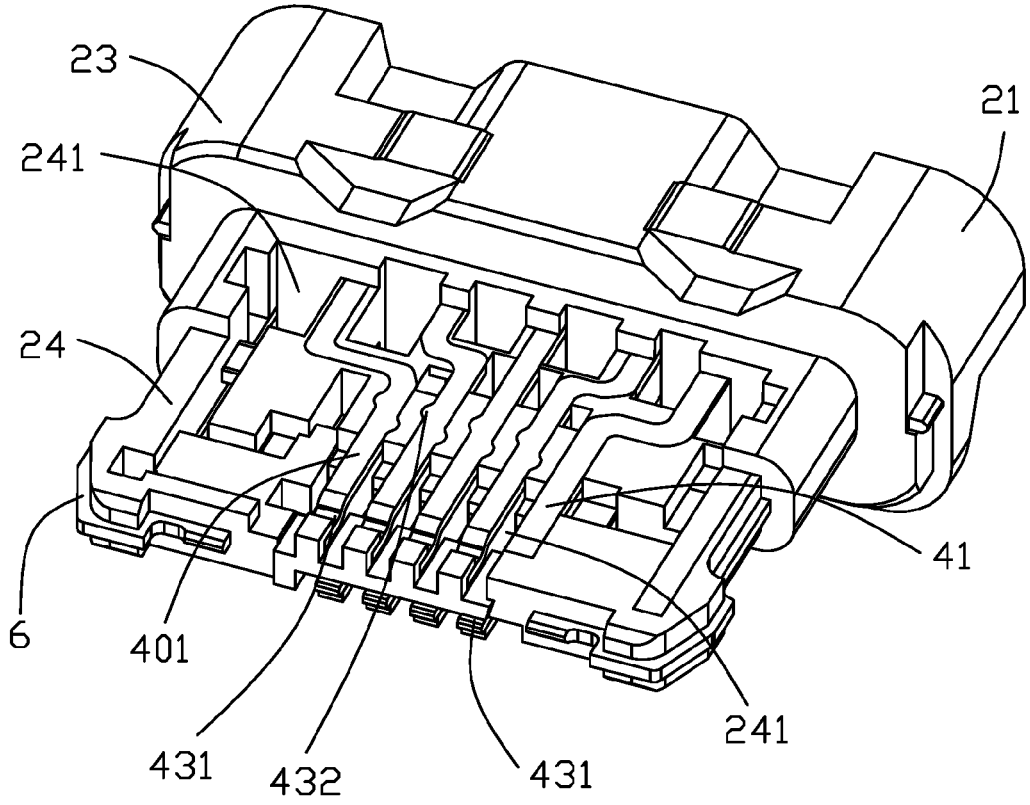
FIG. 7 is a perspective, assembled view of the electrical connector removing the shielding shell and a second insulator.
Figure 8:
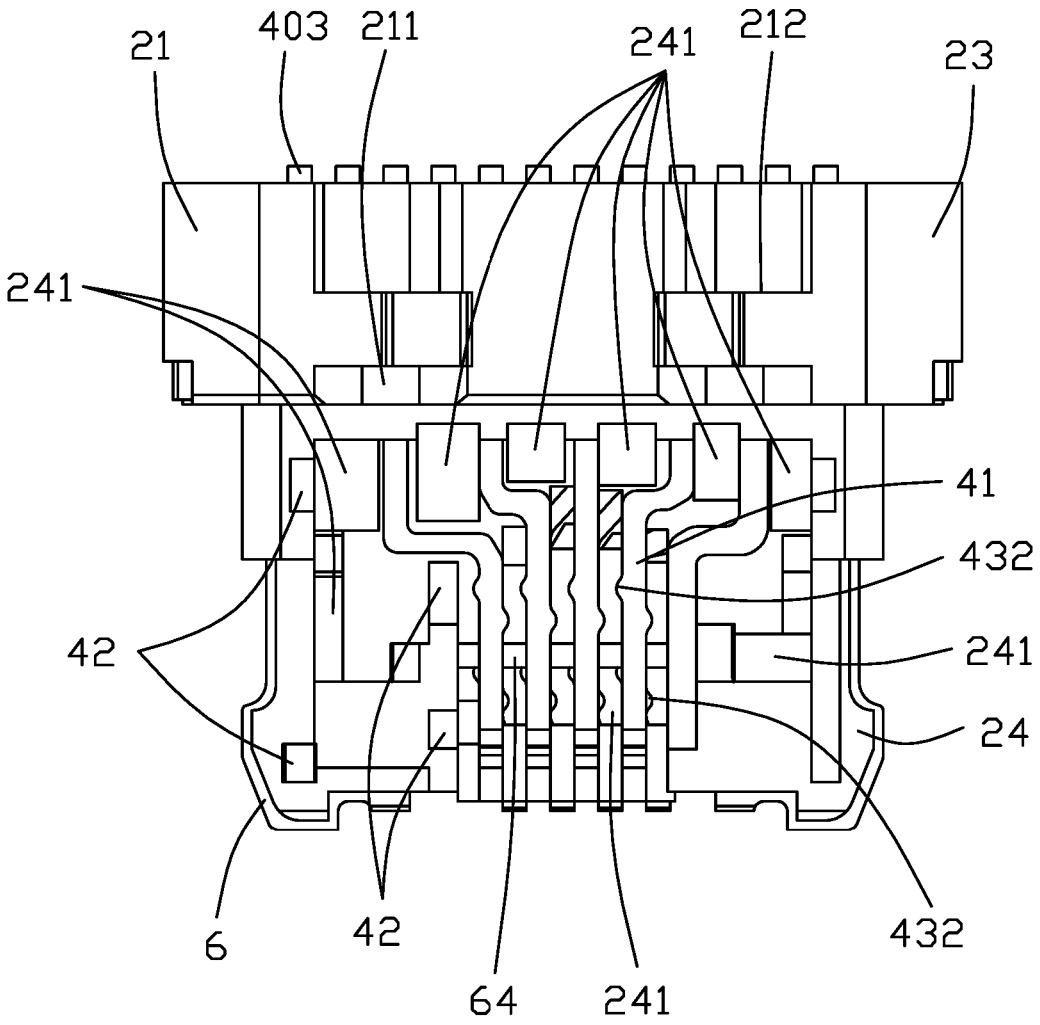
FIG. 8 is a top view of the electrical connector taken from FIG. 7.
Figure 9:
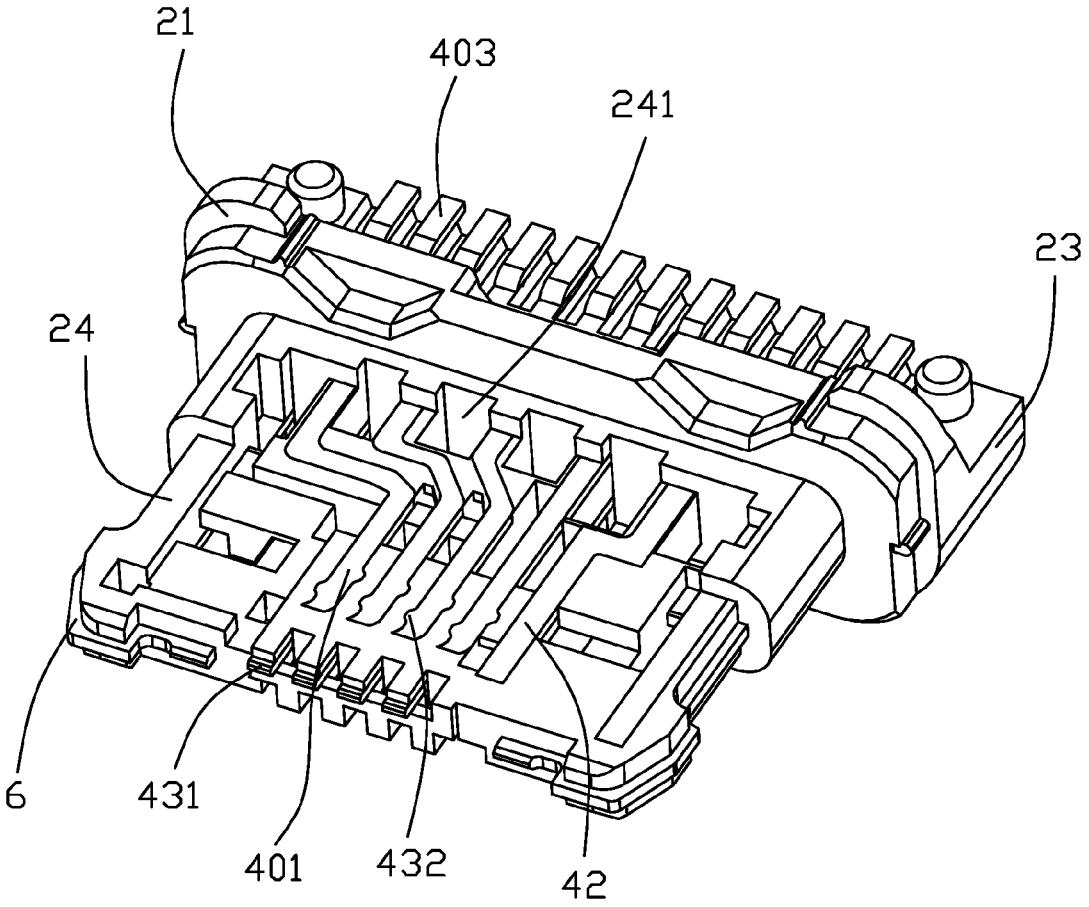
FIG. 9 is another perspective, assembled view of the electrical connector taken from FIG. 7.
Figure 10:
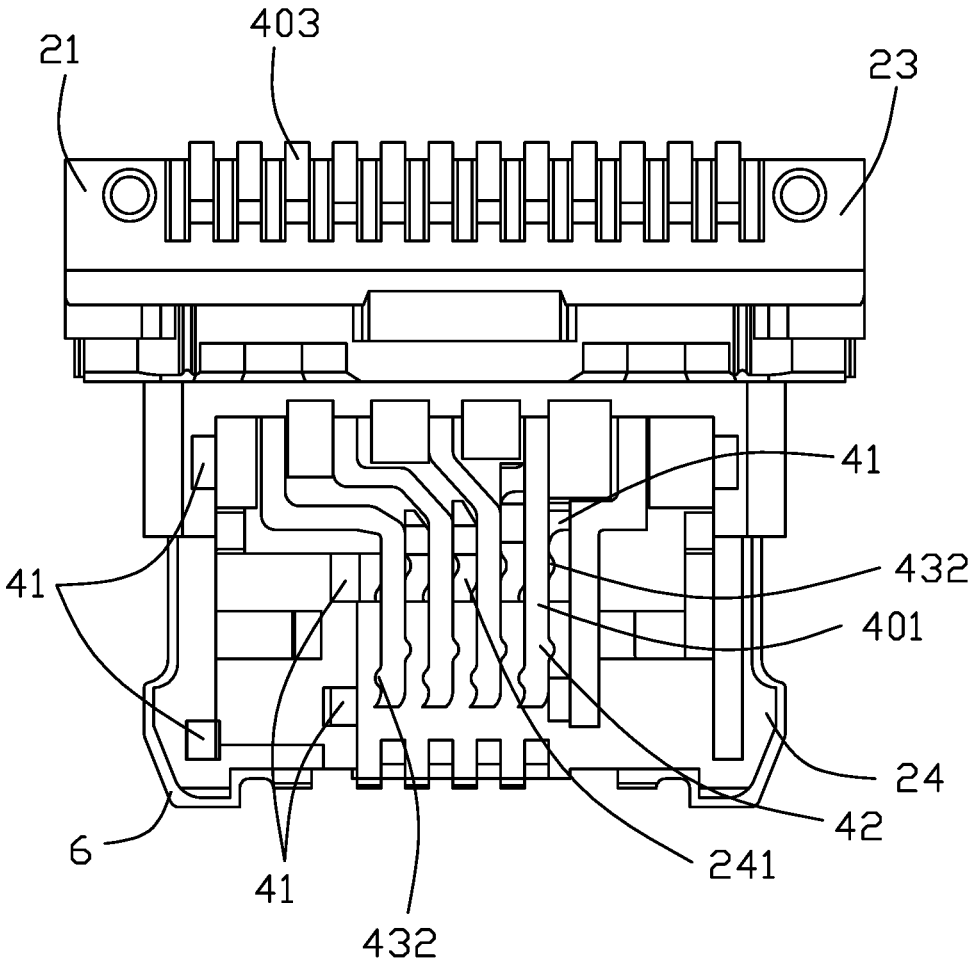
FIG. 10 is a bottom view of the electrical connector taken from FIG. 7.
Figure 11:
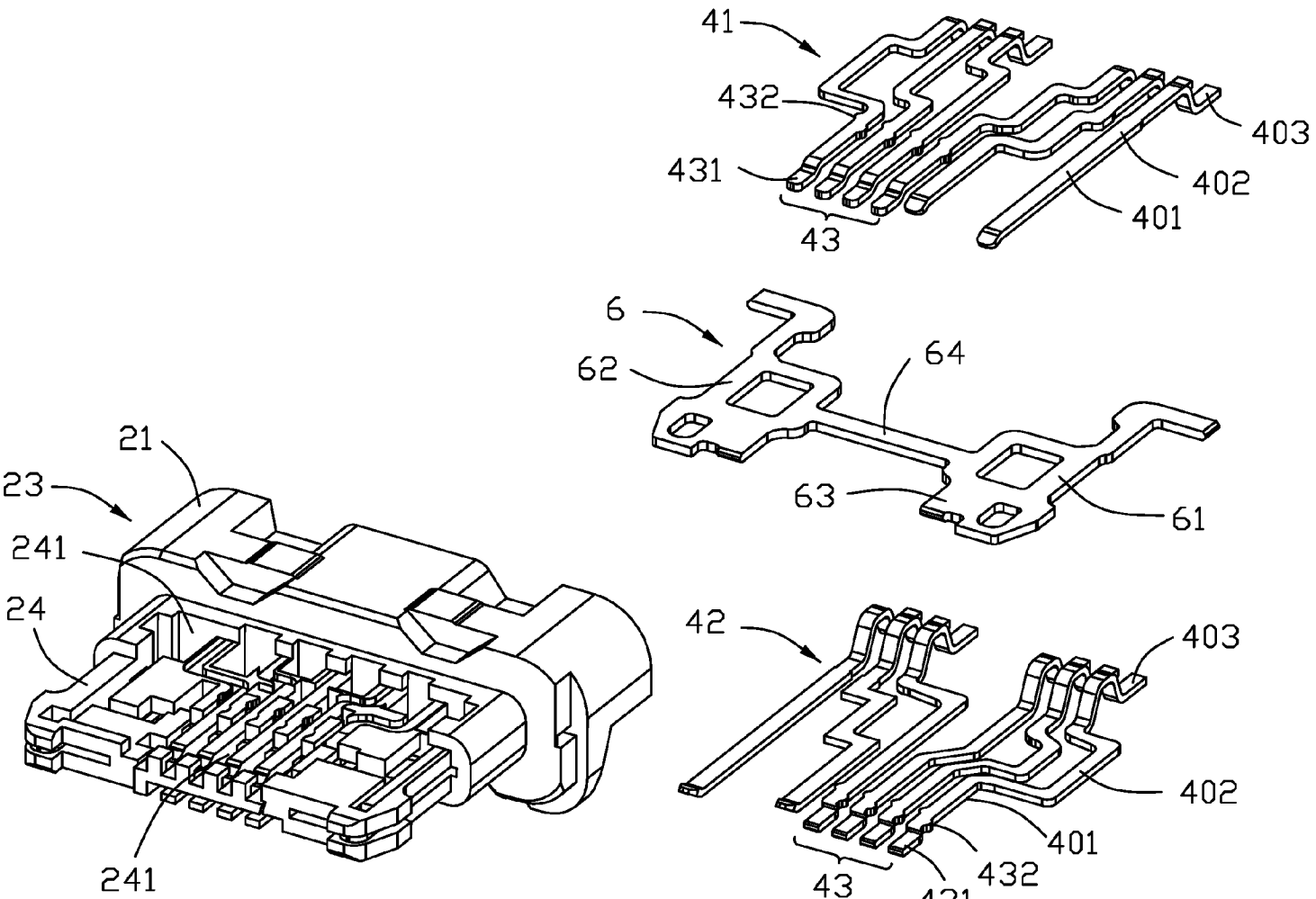
FIG. 11 is an exploded view of the electrical connector removing the shielding shell and the second insulator.
Figure 12:
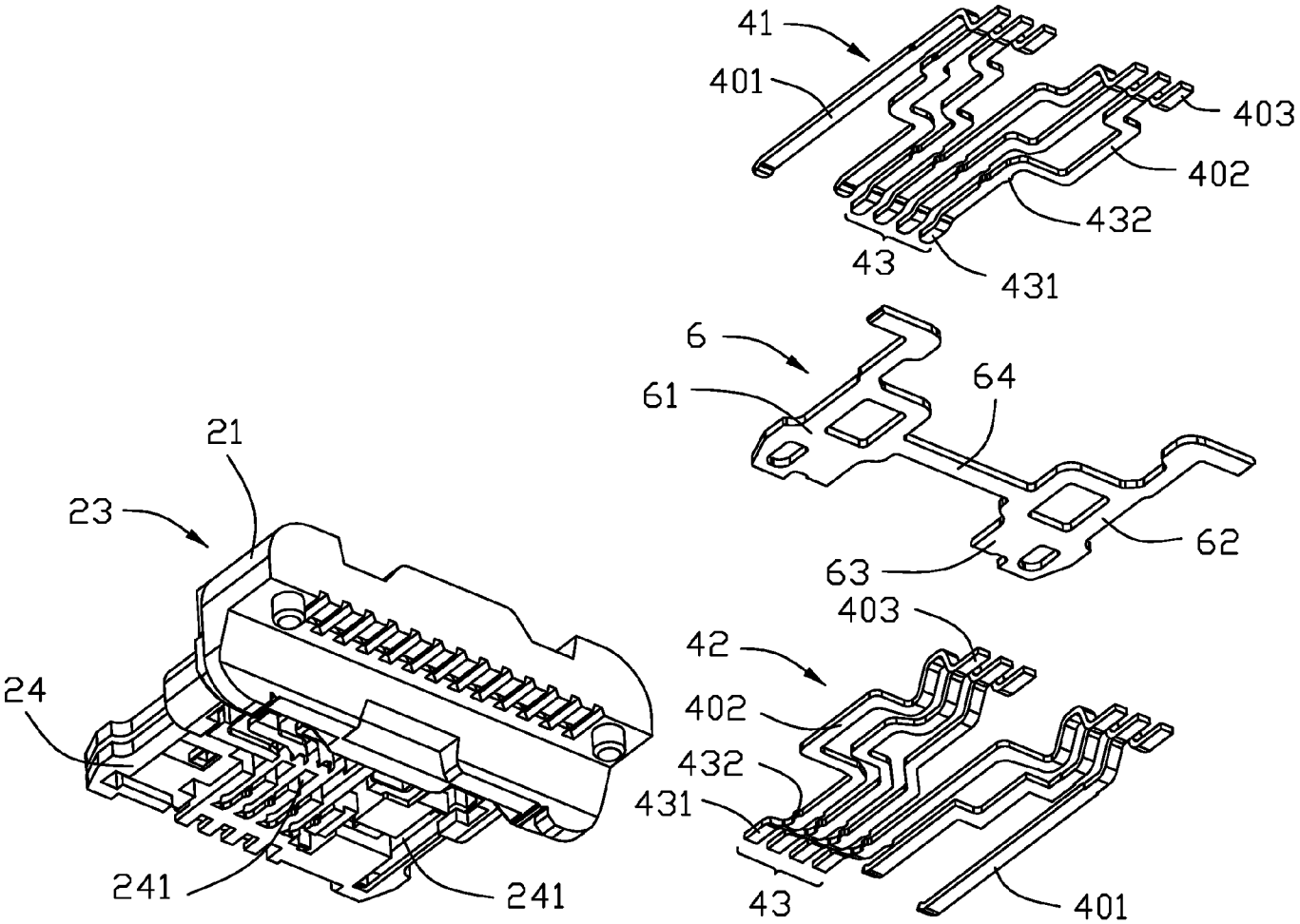
FIG. 12 is another exploded view of the electrical connector taken from FIG. 11.
Figure 13:
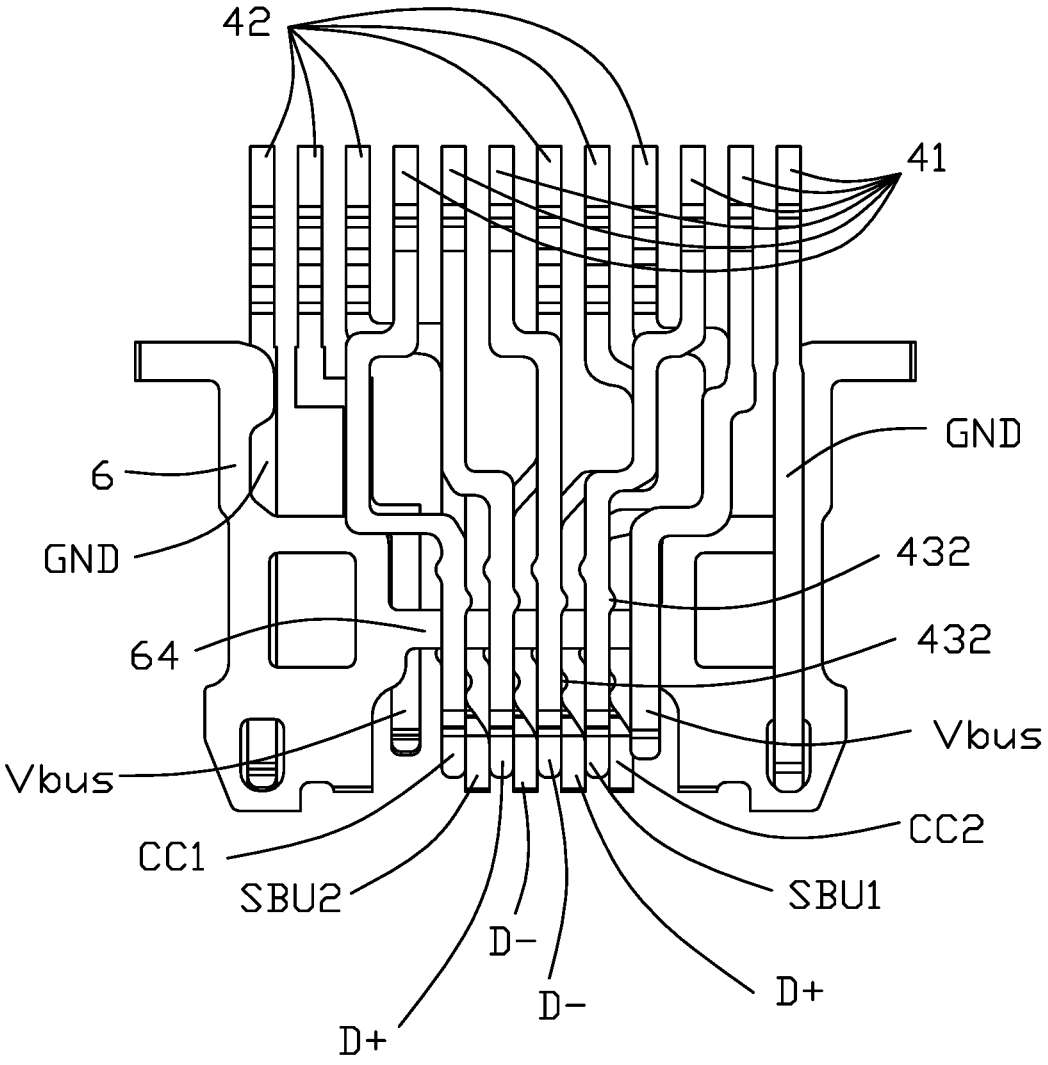
FIG. 13 is a bottom view of the electrical connector removing the shielding shell, the second insulator and a first insulator.

Compared with the prior arts, the electrical connector 100 of the present invention has a total of twelve conductive terminals 4, which not only meets USB2.0 specification, large current applications from 3 A to 5 A, and is intermateable with Type C plug, but also transmits auxiliary signals as needed. The ears 431 of the first contacts 43 contribute to the mold resisting against the first contacts 43 making the process easier and improving yield. Notably, on one hand, the left ear and the right ear of each contact are offset from each other in the front-to-back direction for preventing interfering with the ears of the neighboring contact in the same row; on the other hand, for the paired upper terminal and lower terminal aligned with each other in the vertical direction, the ears of the upper terminal are offset from those of the corresponding lower terminal in the front-to-back direction so as to prevent interference of the corresponding mold used for supporting the upper terminal and that used for supporting the lower terminal. It is also noted that as mentioned before the front portions 431 of the upper terminals 41 are offset from the front portions 431 of the lower terminals 42 in both the front-to-back direction an the transverse direction wherein on one hand, the front portions 431 of the upper terminals 41 are located behind the front portions 431 of the lower terminals 42; one the other hand, the front portions 431 of the upper terminals 41 are essentially aligned with the corresponding contacting portions 401 in the front-to-back direction while the front portions 431 of the lower terminals 42 are offset from the corresponding contacting portions 401 in the transverse direction. It is also noted that as shown in FIG. 7, the front portions 431 of the upper terminals 41 are hidden behind the first insulator 23 while the front portions 431 of the lower terminals 42 are exposed outside of the first insulator. Anyhow, the front portions 431 of the upper terminals 41 and those of the lower terminals 42 are both hidden behind the second insulator 25 which is applied upon the first insulator 23. Referring to FIGS. 12-13, another feature of the invention is to have the tail portions 403 of the upper terminals 41 arranged with two groups each having three as well as those of the lower terminals 42, and further alternately arranged with each other so as to have three tail portions 403 of the upper terminals 41, three tail portions 403 of the lower terminals 42, three tail portions 403 of the upper terminals 41 and three tail portions 403 of the lower terminals 42 in sequence with equal intervals along the transverse direction wherein the tail portions are aligned with the corresponding terminal positions along the front-to-back direction in a top view.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing comprising a base portion and a tongue portion extending forwardly from the base portion;

a plurality of upper and lower terminals mounted in the insulative housing and exposed to an upper surface and a lower surface of the tongue portion, the upper terminals and the lower terminals being equal in number, both the upper terminals and the lower terminals comprising five intermediate terminals arranged centrally in succession and one grounding terminal spaced from the five intermediate terminals by two terminal positions, a respective reserved space being formed between every two adjacent terminals of the five intermediate terminals, the five intermediate terminals comprising an auxiliary terminal; and a shielding plate disposed between the upper terminals and the lower terminals, wherein each terminal comprises a contacting portion exposed to the tongue portion, a fixing portion affixed to the insulative housing, and a soldering portion extending out of the insulative housing, and both the plurality of upper and lower terminals comprise a plurality of first contacts each having an ear extending laterally from the contacting portion for resisting against a mold, and the ears of the plurality of first contacts of the upper terminals are offset from the ears of the plurality of first contacts of the lower terminals in a front-to-rear direction.

2. The electrical connector as claimed in claim 1, wherein the upper terminals are arranged in one row and the lower terminals are arranged in another row, and each row of terminals consists of seven terminals comprising the five intermediate terminals.

3. The electrical connector as claimed in claim 1, wherein the tongue portion comprises twelve terminal positions at each of the upper and lower surfaces, and the five intermediate terminals in each of the upper terminals and the lower terminals are affixed at the tongue portion from a fifth position of the twelve terminal positions to a ninth position of the twelve terminal positions and consists of a detecting terminal, a USB2.0 positive signal terminal, a USB2.0 negative signal terminal, the auxiliary terminal, and a power terminal.

4. The electrical connector as claimed in claim 1, wherein the shielding plate is sandwiched between the upper terminals and the lower terminals, the shielding plate comprises a main portion having a right portion, a left portion arranged in symmetry with the right portion and a connecting arm, and the connecting arm is offset from the ear in the front-to-rear direction.

5. The electrical connector as claimed in claim 1, wherein each first contact comprises a front portion extending forwardly from the contacting portion and having a resisting space, and the front portions of the upper terminals are laterally offset from the front portions of the lower terminals in a transverse direction perpendicular to the front-to-rear direction.

6. The electrical connector as claimed in claim 1, wherein the insulative housing comprises a first insulator and a second insulator, the first insulator, the upper terminals, the lower terminals, and the shielding plate are insert molded to be an integrated unit, the first insulator further includes a plurality of resisting grooves, and each contacting portion is partially exposed to the resisting groove.

7. The electrical connector as claimed in claim 6, wherein the second insulator is insert molded with the integrated unit to form the insulative housing.

8. The electrical connector as claimed in claim 1, further comprising a shielding shell enclosing the insulative housing for forming a mating room.

9. The electrical connector as claimed in claim 1, wherein the five intermediate terminals are affixed at the tongue portion from the fifth position to the ninth position and comprise a detecting terminal, a USB2.0 positive signal terminal, a USB2.0 negative signal terminal, the auxiliary terminal, and a power terminal.

10. An electrical connector comprising:

an insulative housing including a base portion and a tongue forwardly extending from the base portion in a front-to-back direction, said tongue portion forming opposite first and second surfaces thereon in a vertical direction perpendicular to said front-to-back direction;

a plurality of first contacts disposed in the housing, each of said first contacts including along the front-to-back direction a first front contacting section exposed upon the first surface, and a first rear tail section exposed outside of the housing, the first front contacting section of each of said first contacts including a first left ear and a first right ear respectively formed on two opposite sides thereof in a transverse direction perpendicular to both said front-to-back direction and said vertical direction;

a plurality of second contacts disposed in the housing, each of the second contacts including along the front-to-back direction a second front contacting section exposed upon the second surface, and a second rear tail section exposed outside of the housing, the second front contacting section of each of said second contacts including a second left ear and a second right ear respectively formed on two opposite sides thereof in the transverse direction; and a metallic shielding plate located between the first contacts and the second contacts in the vertical direction; wherein in each of the first contacts the first left ear is offset from the first right ear in the front-to-back direction; in each of said second contacts the second left ear is offset from the second right ear in the front-to-back direction; wherein the first left ear and the first right ear of each of said first contacts are offset from the second left ear and the second right ear of each of said second contacts in the front-to-back direction.

11. The electrical connector as claimed in claim 10, wherein the first contacting sections of some of said first contacts are essentially aligned with the second contacting section of some corresponding second contacts in the vertical direction except that front end regions of said some of the first contacting sections are offset from those of the corresponding second contacting sections in both the front-to-back direction and the transverse direction.

12. The electrical connector as claimed in claim 11, wherein the insulative housing includes a first insulator initially enclosing the first contacts, the second contacts and the shielding plate via an insert-molding process, and a second insulator successively applied upon the first insulator, and the front end regions of said some of the first contacting sections are hidden behind the first insulator while the front end regions of the corresponding second contacting sections are exposed outside of the first insulator.

13. The electrical connector as claimed in claim 12, wherein the front end regions of both said some the first contacting sections and those of the corresponding second contacting sections are hidden behind the second insulator.

14. The electrical connector as claimed in claim 12, wherein the front end regions of said some of the first contacting sections are aligned with main portions of said some of the first contacting sections while the front end regions of the corresponding second contacting sections are offset from main portions of the corresponding second contacts in the transverse direction.

15. The electrical connector as claimed in claim 10, wherein there are twelve terminal positions with equal intervals on each of said first surface and second surface, the first contacts occupy five intermediate terminal positions and one outermost position with two terminal positions vacant therebetween, and the second contacts occupy five intermediate terminal positions and one outermost position with two terminal positions vacant therebetween, arranged in a reversely symmetrical manner with respect to the first contacts.

16. The electrical connector as claimed in claim 10, wherein the shielding plate includes a right section and a left section with a connecting arm therebetween in the transverse direction, and the first left ear and the first right ear of the first contact and the second left ear and the second right ear of the second contact are respectively located by two sides of the connecting arm in the front-to-back direction.

17. An electrical connector comprising:

an insulative housing including a base portion and a tongue forwardly extending from the base portion in a front-to-back direction, said tongue portion forming opposite first and second surfaces thereon in a vertical direction perpendicular to said front-to-back direction;

a plurality of first contacts disposed in the housing, each of said first contacts including along the front-to-back direction a first front contacting section exposed upon the first surface, and a first rear tail section exposed outside of the housing;

a plurality of second contacts disposed in the housing, each of the second contacts including along the front-to-back direction a second front contacting section exposed upon the second surface, and a second rear tail section exposed outside of the housing; and a metallic shielding plate located between the first contacts and the second contacts in the vertical direction; wherein there are twelve terminal positions with equal intervals on each of said first surface and second surface, the first contacts occupy five intermediate terminal positions and one outermost position with two terminal positions vacant therebetween, and the second contacts occupy five intermediate terminal positions and one outermost position with two terminal positions vacant therebetween, arranged in a reversely symmetrical manner with respect to the first contacts, wherein there are six first contacts with corresponding first rear tail sections arranged in a first group of three first rear tail sections and a second group of three first rear tail sections, there are six second contacts with corresponding second rear tail sections arranged in a first group of three second rear tail sections and a second group of three second rear tail sections, and the two groups of first rear tail sections and the two groups of second rear tail sections are alternately arranged along the transverse direction in a sequence of: the first group of three first rear tail sections, the first group of three second rear tail sections, the second group of three first rear tail sections, the second group of three second rear tail sections.

18. The electrical connector as claimed in claim 17, wherein all twelve said first rear tail sections and said second rear tail sections are spanned in the transverse direction with equal intervals and aligned with the corresponding twelve terminal positions, respectively, in the front-to-back direction, in a top view.

* * * * *